US007013900B2

(12) United States Patent
Silva

(10) Patent No.: US 7,013,900 B2
(45) **Date of Patent: *Mar. 21, 2006**

(54) HAIR-BAND COMB FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 0 days.

This patent is subject to a terminal disclaimer.

(21) Appl. No.: 10/309,926

(22) Filed: Dec. 3, 2002

(65) Prior Publication Data

US 2004/0103909 A1 Jun. 3, 2004

(51) Int. Cl.
*A45D 24/00* (2006.01)
*A45D 8/04* (2006.01)

(52) U.S. Cl. ..... 132/200; 132/273

(58) Field of Classification Search ..... 132/273, 132/219, 128, 144, 148, 275, 278, 200
See application file for complete search history.

(56) References Cited

U.S. PATENT DOCUMENTS 715,600 A * 12/1902 Pomeroy ..... 132/101
1,221,996 A * 4/1917 Kahn ..... 132/278
RE16,546 E * 2/1927 Parker ..... 132/128
1,706,136 A * 3/1929 Beattie ..... 132/145
1,823,361 A * 9/1931 Hudson ..... 132/128
1,825,170 A * 9/1931 Allen ..... 132/128
1,909,677 A * 5/1933 Hemmingson ..... 132/128
2,454,642 A * 11/1948 Finman ..... 132/141
5,732,720 A * 3/1998 Sears ..... 132/128
5,787,904 A * 8/1998 Michaud ..... 132/200
6,047,705 A * 4/2000 Hawley ..... 132/128
6,123,086 A * 9/2000 Kuglen ..... 132/275
6,427,702 B1 * 8/2002 Silva ..... 132/275

* cited by examiner

*Primary Examiner*—John J. Wilson
*Assistant Examiner*—Robyn Doan

(57) ABSTRACT

A hair-band comb fastener and method for securing sections of hair of a human being. The apparatus comprises a retaining comb with an attaching member toward an end of the comb base and a resilient band attached toward the other end of the comb base. The resilient band has an attaching means for mating with the attaching member on the comb base. Whereby, the comb can be placed in the user's hair, a hair section can be placed in front of the comb, the band can be stretched across the hair section, and the attaching member on the band can be secured to the attaching member on the comb base.

6 Claims, 9 Drawing Sheets

HAIR-BAND COMB FASTENER

BACKGROUND OF THE INVENTION

1. Field of the Invention

The present invention and method relates to a retaining comb with one or more elastic bands attached to its base. More particularly a retaining comb with one or more elastic hair-bands attached to its base for stretching over a hair section and attaching back to the comb.

2. Description of Prior Art

Many people like to put their hair up in various styles. One way to put hair up is to use a retaining comb or an elastic band. These items are effective, however the current invention combines the two to create a new hair accessory and hairstyling method that holds upswept hair in a novel way that is easier, quicker, less damaging, and more secure to use.

SUMMARY OF THE PRESENT INVENTION

An object of the present invention is to provide an instrument which is convenient, practical, and inexpensive for use in hair styling.

A further object is to provide an instrument that will keep a single or a plurality of hair sections neatly secured.

A further object is to provide a retaining-comb that will keep a single or a plurality of hair-bands attached to its base.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided a retaining comb with one or more hair-bands attached to its base toward one end and a ledge portion extending out further than the comb teeth at the other end of the comb base, so the looped band can be stretched across the comb base from where it is attached and secured to the extended portion, by placing the band around it.

According to the arrangement described above, the retaining comb is placed in the user's hair. The user then places hair in front of the comb base, stretches the band across and over the hair section, and secures it to the protruding end at the opposite side of the comb base.

Accordingly a preferred embodiment, the comb, which is made of plastic, has a plurality of elongated teeth. The comb base extends linearly out from each side longer than the width of all the comb teeth; the extended portion is a ledge substantially perpendicular to the comb teeth creating a somewhat right angle. The band is a loop made of elastic and is attached toward one end by a hook on the back of the comb base and is pulled across and attached to the other end by placing the band around the protruding part of the base. The hook holding the band has a narrow opening which has just enough space to fit the band through, which allows the user to either remove the band and replace it with a new one when the band becomes worn out or to change the band color. The user can also add more than one band to secure additional hair sections to the comb or to make different color patterns by mixing and matching the colors. The comb teeth keep the comb secure in the hair while being hidden within. The teeth also hold the invention in place making it easier for the user to maneuver the hair in front of the comb base and to attach the band to the protruding end. Further, they create a support for holding a heavy section of hair to the comb base. The resilient bands enable a large amount of the user's hair to be held to the comb base because the band stretches over the hair section. It also makes the band adjustable to different size hair sections. There can also be an additional band attached to the opposite end of the first band to stretch across the base toward the first band to be attached to a protruding portion at the first bands end. This enables a second hair section to be attached or to fold and secure the first attached section.

The comb can also have the bands attached to the center of the base, with two protruding portions at each end. In use of this embodiment two sections of hair are attached to the comb base by stretching each band away from each other toward the protruding portions and attaching around them with hair there between.

In another embodiment the band is a strip of elastic fabric with a pocket at its end. The pocket is formed by folding the elastic free end and stitching its edges. The band is stretched across the base with the hair there between and the pocket is attached to the protruding portion.

In another embodiment the comb base has a hook on it, in place of the protruding portion at one end, with a looped band at the other (or pocketed band). In use the band is stretched across the comb and attached to the hook. This version can also have two bands attached to the center of the base with a hook at each end of the comb base. In use of this embodiment two sections of hair are attached to the comb base by stretching each band away from each other toward the hooks and attached to them with hair there between. Further, this embodiment can have the two hooks at its center with the bands attached at each end. The bands are stretched and attached toward comb center with hair there between.

In another embodiment the band is a strip of elastic with a hook fastener on its underside for mating with a loop fastener on the comb base. This can be one hook and loop or many hook and loops like Velcro.

All of the bands in the invention can have an additional covering of fabric (scrunchie) covering the bands.

In another embodiment the comb base has a plurality of bands spaced along the comb base, either on the top of the base or the bottom. The loop openings face the comb teeth free ends and each band is in alignment with a corresponding tooth. In use the user places the comb in the hair, pulls each band across and over the hair, and secures each band to its corresponding tooth by placing the loop around the tooth tip. The bands can be attached by either hooks along the base that allow the bands to be removably attached or they could be non-removable, or any other way to attach the bands will work. Having the band removably attached allows the user to change the band color or replace the band when it wears out.

Other objects, features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
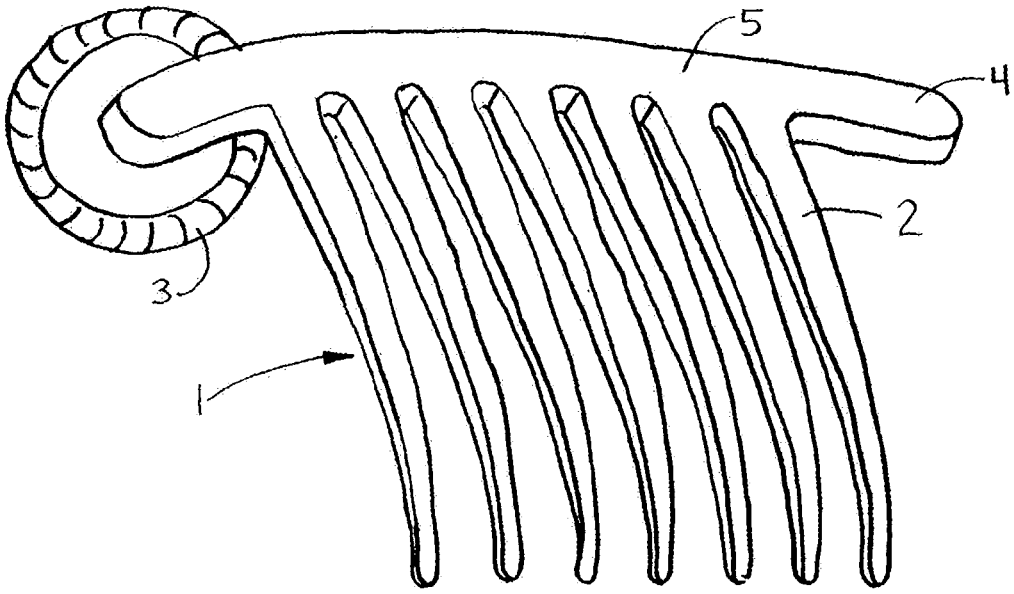
FIG. 1 is a front view showing a hair-band comb fastener according to the present invention.

Referring to FIG. 1 of the accompanying drawings, there is illustrated a looped hair-band comb fastener, generally designated by reference numeral 1, embodying the present invention. The hair fastener 1 comprises a first comb portion 2 and a band 3. Each band 3 is a loop and the comb portion 2 has a protruding portion 4 on the comb base 5.

Figure 2:
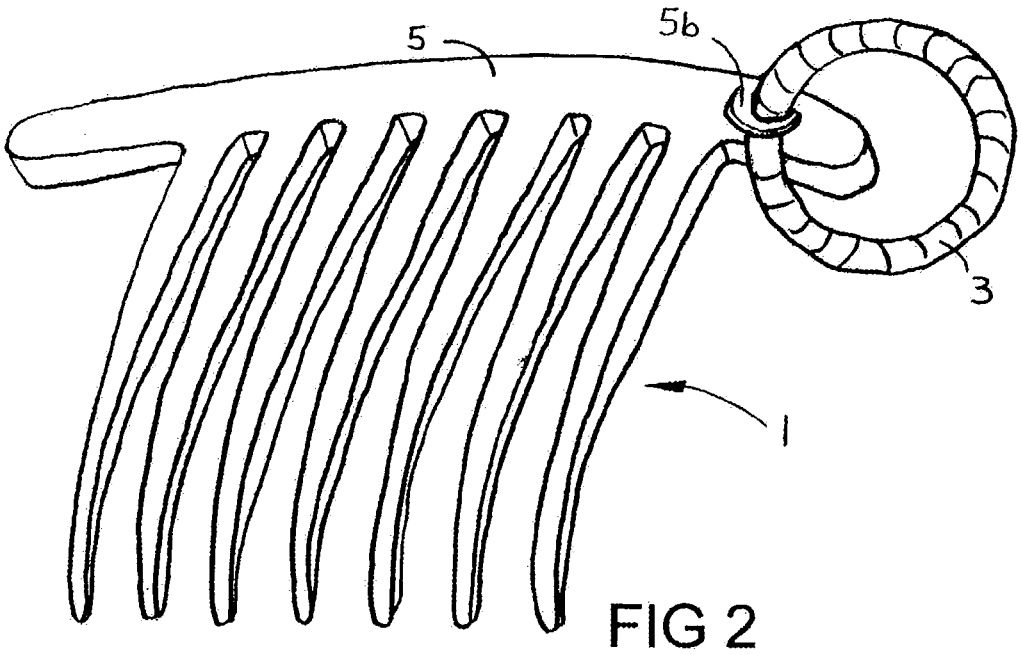
FIG. 2 is a back view of the current invention.

FIG. 2 shows the back of the hair-band comb fastener 1 wherein the band 3 is attached to the base 5 by a hook 5*b* which allows the band 3 to be removably connected to the base 5 for replacing the band 3 with a different color or to add additional bands.

Figure 3:
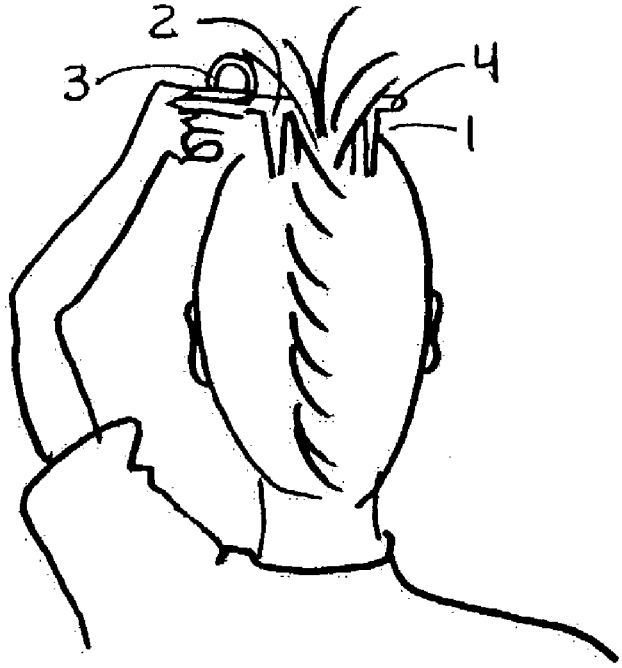
FIG. 3 is a schematic view showing the hair-band comb fastener being placed in the user's hair.

In use of the hair-band comb fastener FIG. 3 the user places the present invention 1 into their hair.

Figure 4:
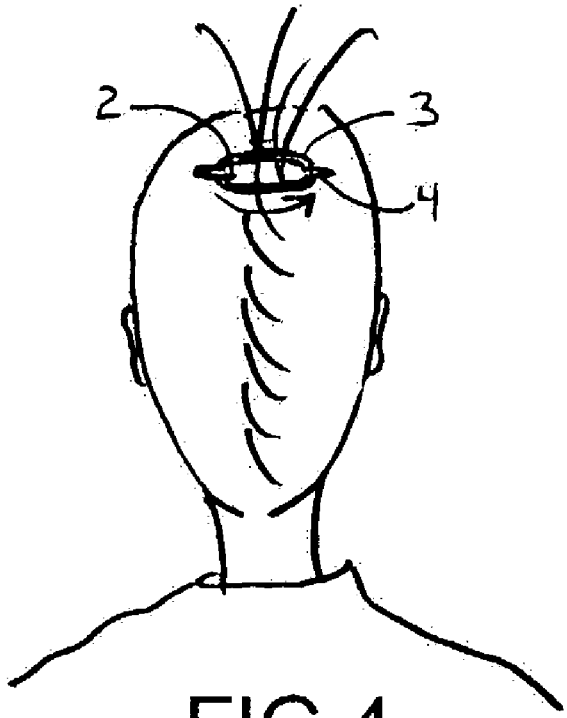
FIG. 4 is a schematic view showing the hair-band comb fastener secured to the user's hair.

The user then places the hair section in front of the comb 2 and stretches the band 3 across the hair and secures the band 3 to the protruding portion 4 FIG. 4.

Figure 5:
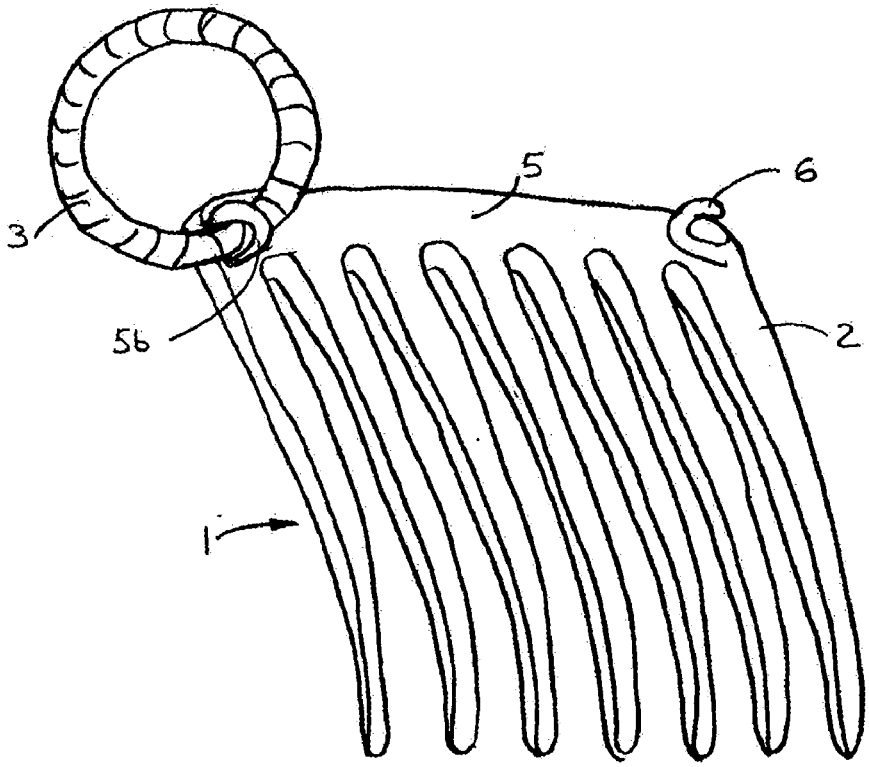
FIG. 5 is another embodiment of the current invention.

In another embodiment FIG. 5 the comb 2 has a hook 6 at one side of the comb base 5 in place of the protruding portion 4 above, for hooking the band thereto.

Figure 6:
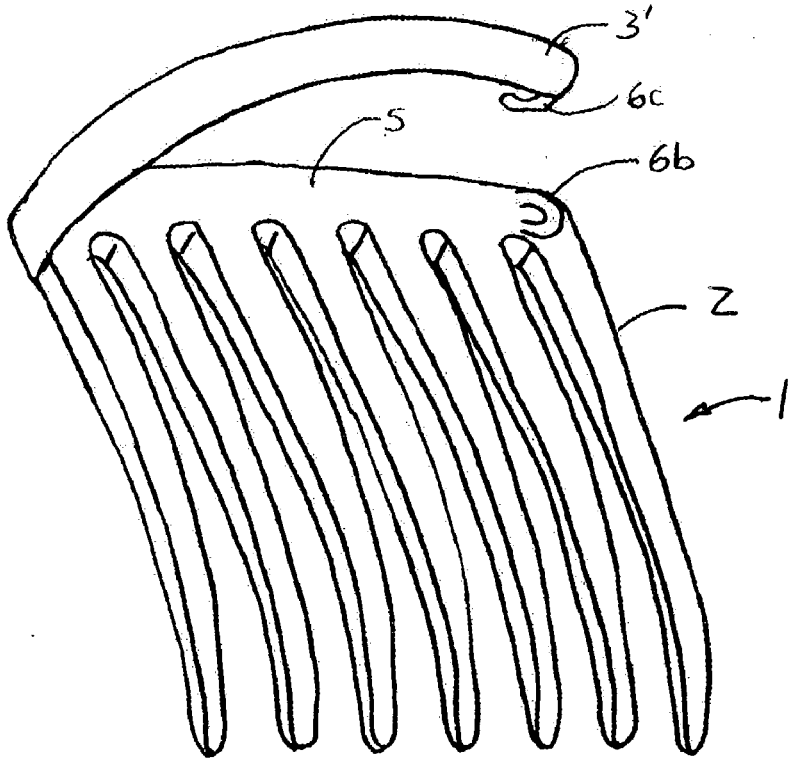
FIG. 6 is another embodiment of the current invention.

In another embodiment FIG. 6 the comb has a hook 6*c* at the end of a length of elastic 3' for mating with hook 6*b* on the comb base 5.

Figure 7:
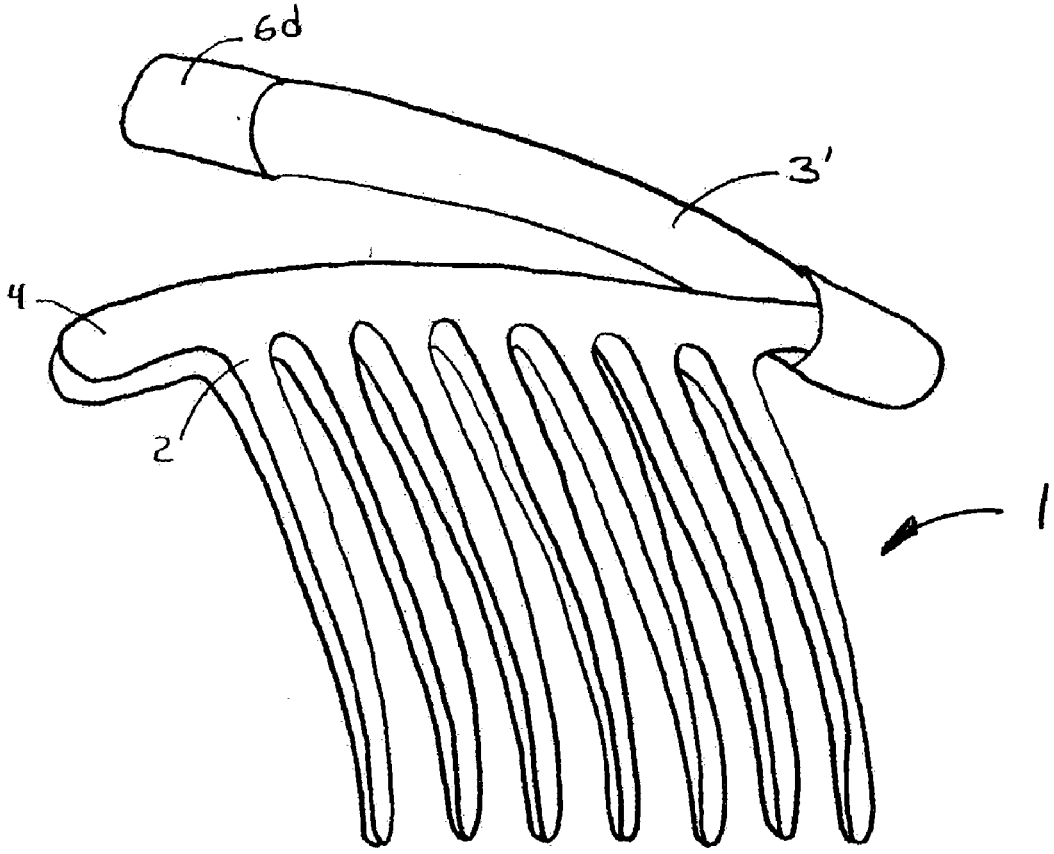
FIG. 7 is another embodiment of the current invention.
Figure 8:
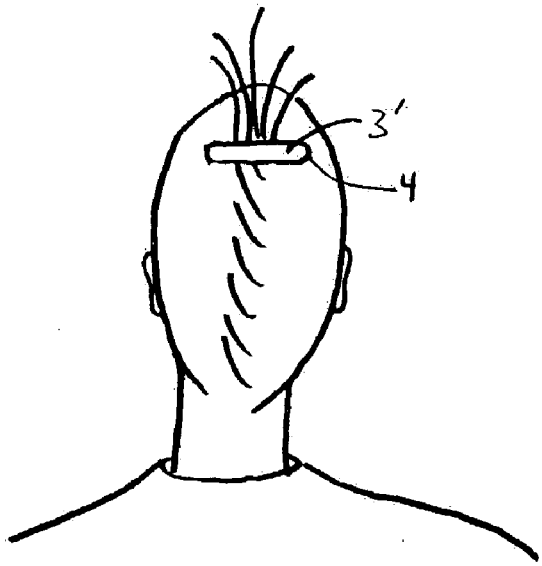
FIG. 8 is a schematic view showing a hair-band comb fastener placed in the user's hair.

In another embodiment FIG. 7 the comb 2 has a strip of resilient fabric 3' in place of the looped band 3. The strip of fabric 3' has a pocket 6*d* attached at one end for engaging the protruding potion 4. In use FIG. 8 a hair section is placed between the fabric strip 3' and the comb base. The fabric 3' is stretched across the hair and secured to the protruding portion 4 by placing the protruding portion into the pocket 6*d*.

Figure 9:
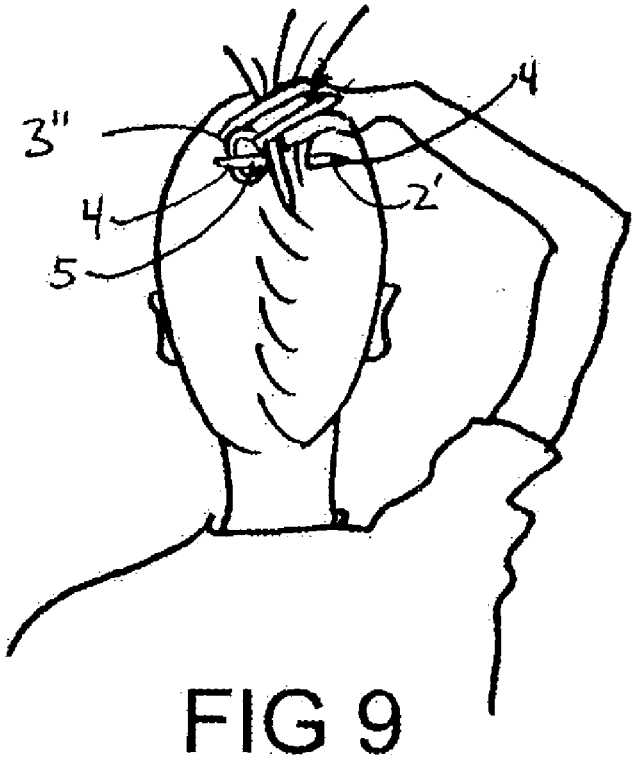
FIG. 9 is a schematic view showing a method of using a hair-band and comb combination.
Figure 10:
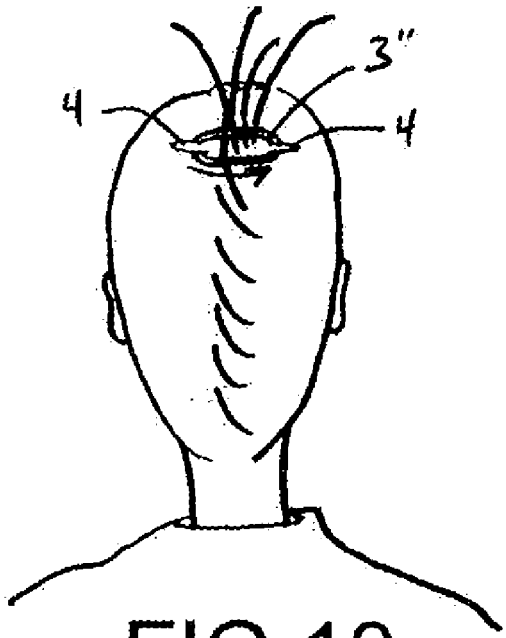
FIG. 10 is a schematic view showing a method of using a hair-band and comb combination.

FIG. 9 and FIG. 10 shows a method using a looped band 3" unattached to the comb 2'. The comb portion 2' has protruding portions 4 on each end of the comb base 5. In use the user places the comb 2' into their hair. The user then places the hair section in front of the comb 2' and attaches the separate looped band around the first protruding portion 4 (FIG. 9). The user then stretches the band 3" across the hair and attaches the other side of the looped band around the second end of the protruding portion 4 (FIG. 10).

Figure 11:
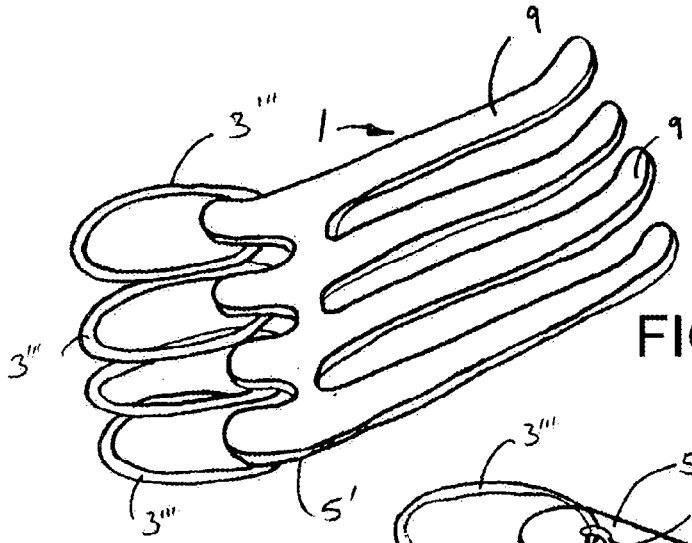
FIG. 11 is another embodiment of the current invention.

FIG. 11 shows a plurality of looped bands 3"' attached to the comb base underside 5' each band 3"' is aligned with a corresponding comb tooth 9.

Figure 12:
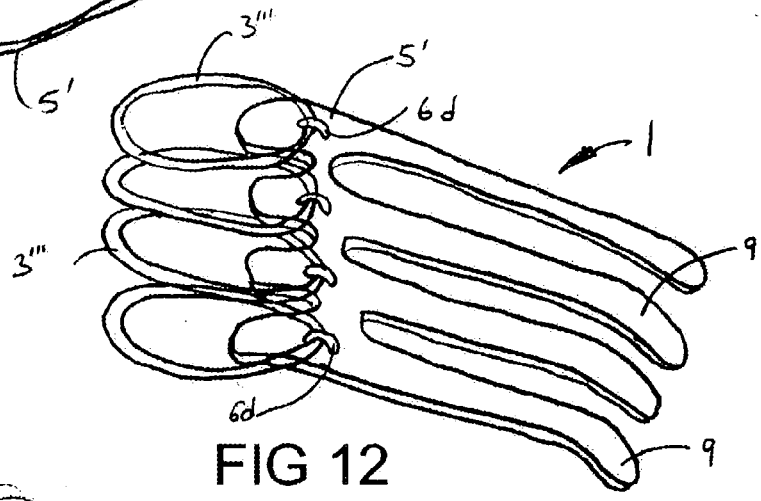
FIG. 12 is a back view of FIG. 11.

FIG. 12 shows the back of FIG. 11 with hooks 6*d* and bands 3"' removably connected to the comb base underside 5'7.

Figure 13:
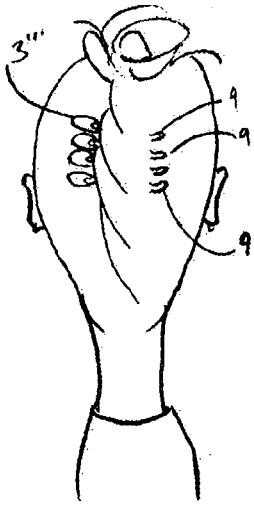
FIG. 13 is a schematic view showing the version in FIG. 11 being placed in the hair.

In use FIG. 13 all comb teeth 9 are placed in the user's upswept hair. Each band 3"' is stretched across the hair section toward the open end of its corresponding tooth 9 and secured around the tooth 9 tip.

Figure 14:
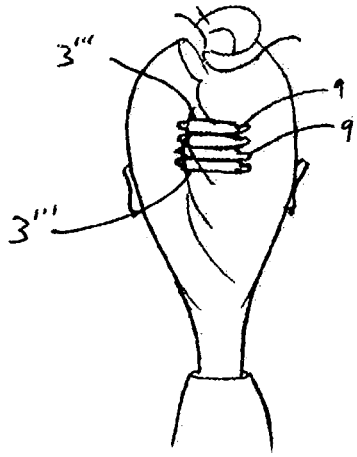
FIG. 14 is a schematic view showing the version in FIG. 11 secured to the user's hair.

FIG. 14 shows the FIG. 11 version attached to the hair.

Figure 15:
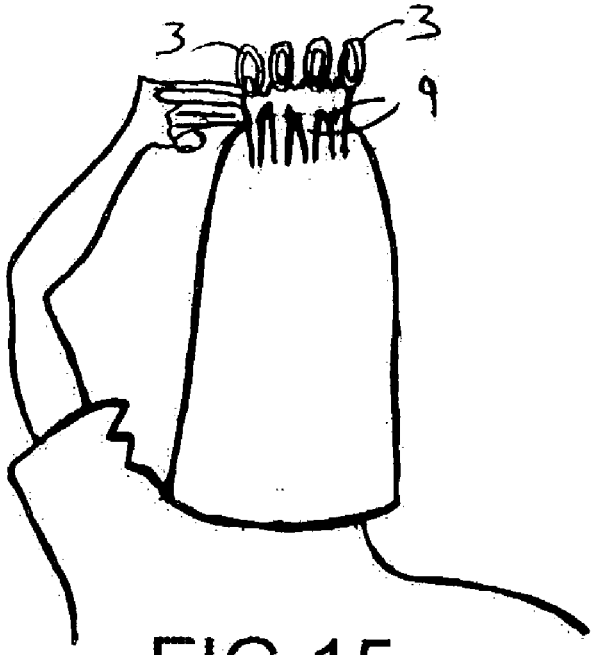
FIG. 15 is another use of the FIG. 11 version.
Figure 16:
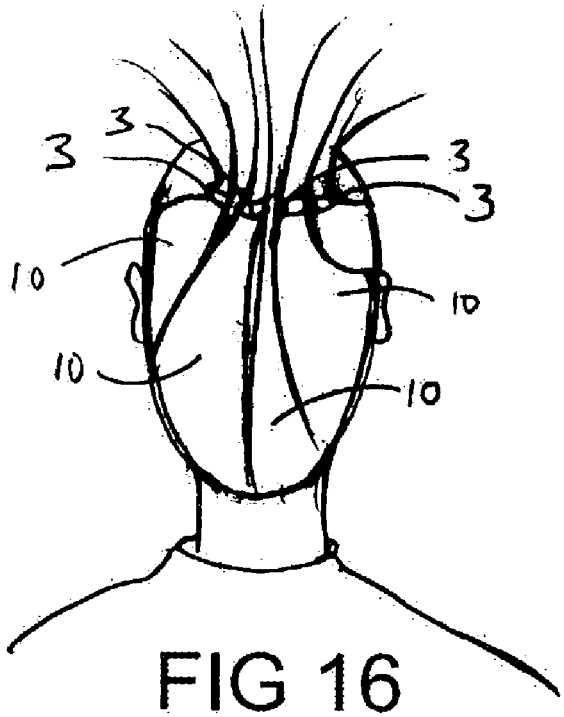
FIG. 16 is a schematic view showing the version of FIG. 15 secured to the user's hair.

FIG. 15 and 16 shows another use for the embodiment of FIG. 11 wherein the user places the comb teeth 9 into the hair and secures each band 3"' to a separate section of hair 10 creating a plurality of pony-tails attached to the comb base.

Figure 17:
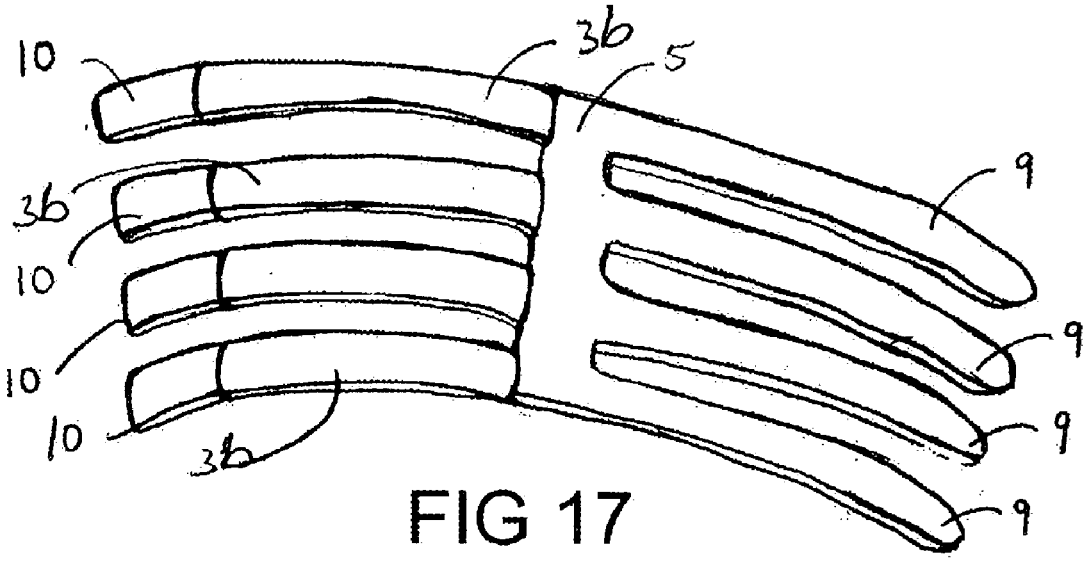
FIG. 17 is another version of the current invention.

FIG. 17 shows a plurality of bands 3*b* with pockets at their ends 10, attached to the comb base 5; each band 3*b* is aligned with a corresponding comb tooth 9.

Figure 18:
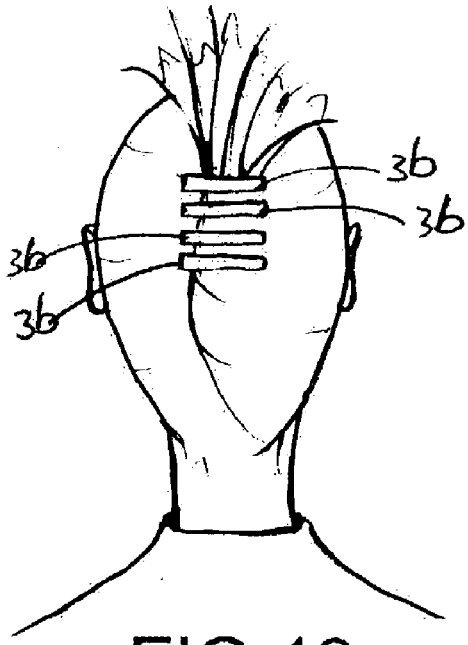
FIG. 18 shows the FIG. 17 version secured to the hair.

In use FIG. 18 all of the comb teeth 9 are placed in the user's upswept hair. Each band 3*b* is stretched over the hair section toward the open end of its corresponding tooth 9 where the pocket is secured to the tooth 9 tip.

Figure 19:
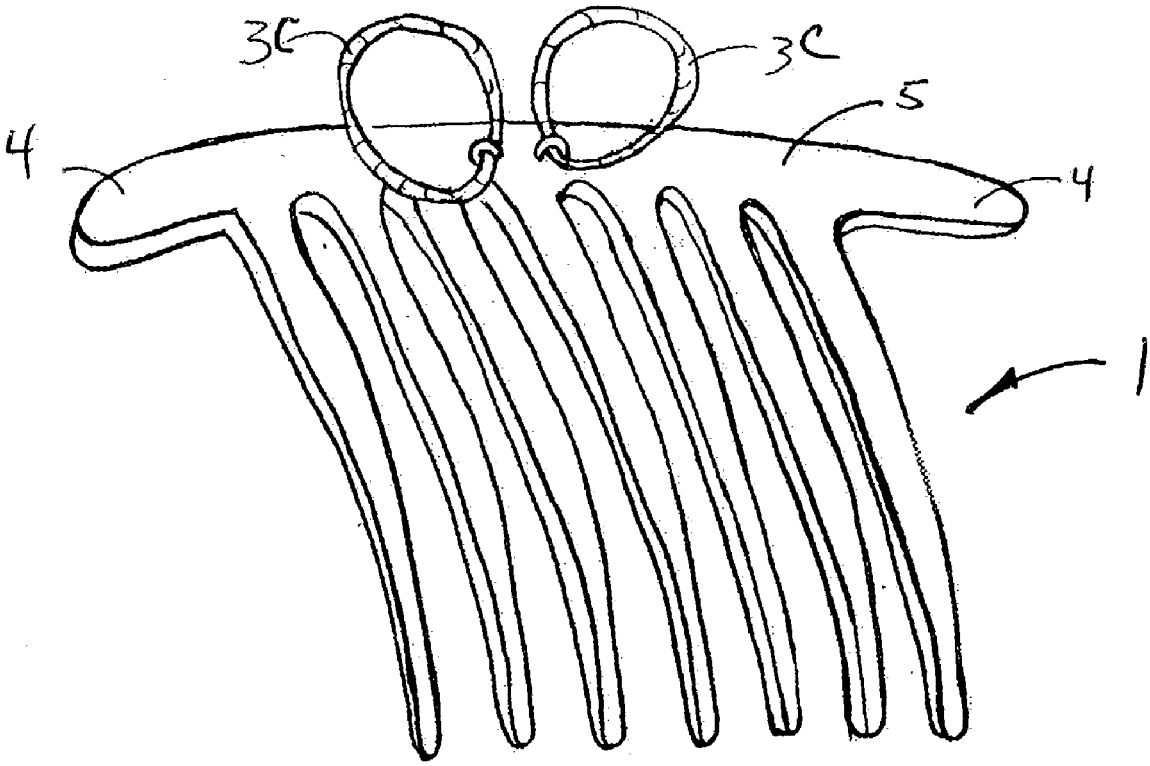
FIG. 19 is another version of the current invention.

FIG. 19 shows two bands 3*c* attached to the center of the comb base 5 with protruding portions 4 at each end of the comb base 5.

Figure 20:
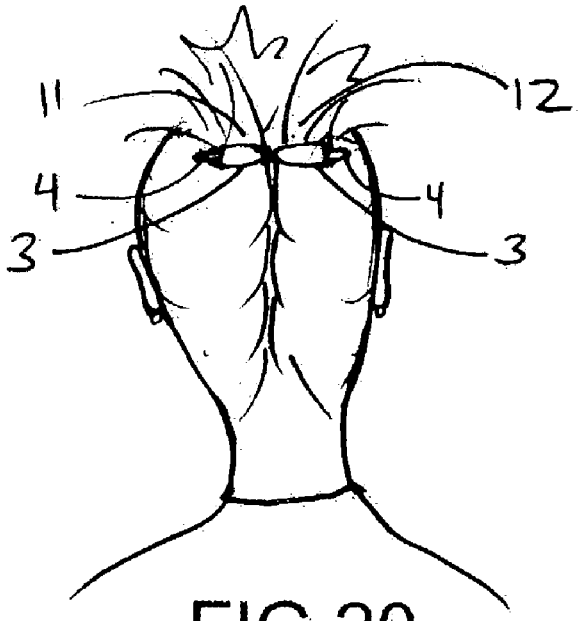
FIG. 20 shows the FIG. 19 version secured to the hair.

FIG. 20 shows the FIG. 19 version attached to the hair with two hair sections 11 and 12 attached thereto.

The present invention being thus described, it is obvious that the same may be varied in many ways. For instance, the hair-bands could be any type of hair-band known in the art, such as a scrunchie (gathered fabric that covers the band) and anyway to attach the bands to the comb will work. Further, any way to use the present invention obvious in the art should apply. Such variations are not to be regarded as a departure from the spirit and scope of the invention, and all such variations as would be obvious to those skilled in the art are intended to be included within the scope of the claims,

I claim:

1. A method of securing a section of hair comprising:

Providing a hair band comb fastener comprising a comb having a base portion with a longitudinal axis, a first and second ends, a plurality of teeth extending perpendicularly to the longitudinal axis of the base, said first end including a first hook integrally attached thereto, an elastic band integrally attached to said base portion by said first hook, a second hook integrally attached to said second end of said base portion;

placing said hair band comb fastener into the hair, placing said section of hair in front of said hair band comb fastener;

stretching the elastic band over said section of hair and the hair band comb fastener, fastening said elastic band with said second hook of said base portion and whereby said hair is secured between said comb and said elastic band.

2. The method of claim 1 wherein a second band is attached by attaching means to the retaining comb base near the first band for securing a second hair section by placing the second hair section in front of said retaining comb and securing said second band by stretching said band over said second hair section and securing said band to said attaching means on said comb base.

3. A method of styling hair comprising: selecting a hair-band comb fastener comprising: a retaining comb with a plurality of resilient hair-bands integrally attached along its base; placing said comb teeth into a section of hair; stretching said bands over said hair in the direction of said come teeth free ends; securing each said band around said comb teeth ends; whereby said hair is secured between said teeth and said bands.

4. The method of claim 3 wherein each said resilient band is a loop.

5. The method of claim 3 wherein each said band is a substantially straight resilient band with a pocket at its free end.

6. A method of securing separate hair sections to the top of a retaining comb base comprising: selecting a hair-band comb fastener comprising: a retaining comb with a plurality of resilient looped hair-bands integrally attached along its base; placing said comb teeth into a section of hair; securing each said band to a said hair section by placing each said hair section into each said band and securing said hair section into a pony-tail; whereby, a plurality of pony-tails are secured to said comb base.

* * * * *